United States Patent [19]

Fleming

[11] 4,313,276

[45] Feb. 2, 1982

[54] TOY CHAIR CONSTRUCTION KIT

[76] Inventor: Robert J. Fleming, 813 SE. 60, Oklahoma City, Okla. 73149

[21] Appl. No.: 138,954

[22] Filed: Apr. 10, 1980

[51] Int. Cl.[3] ..... A63H 33/00; A63H 3/52; B60G 11/02

[52] U.S. Cl. ..... 46/16; 46/1 R; 46/15; 269/37

[58] Field of Search ..... 46/1 R, 16, 14, 15, 46/24; 24/252 R, 137 R; D7/198; D21/108, 121, 123; D6/30, 31; 269/37, 40

[56] References Cited

U.S. PATENT DOCUMENTS

| | | | |
|---|---|---|---|
| D. 111,657 | 10/1938 | Little | D21/123 |
| 1,257,389 | 2/1918 | Platt | 46/15 |
| 1,271,386 | 7/1918 | Tarbox | 269/40 |
| 1,656,199 | 1/1928 | Hodgson | 46/16 |
| 2,353,954 | 7/1944 | Duffy et al. | 269/40 |
| 3,099,439 | 7/1963 | Haselton | 269/40 |
| 3,757,393 | 9/1973 | Bucheli | 46/16 |
| 3,973,765 | 8/1976 | Babcock | 269/37 |

*Primary Examiner*—Robert Peshock
*Assistant Examiner*—Michael J. Foycik
*Attorney, Agent, or Firm*—Robert K. Rhea

[57] ABSTRACT

A ready-to-assemble kit for forming a toy chair includes a rigid workboard and a plurality of clothespins. The clothespins are identical pairs of rigid wooden elements. The workboard is characterized by a rectangular upwardly open area on its top surface encompassing a plurality of juxtaposed clothespins when arranged in glued together pairs. The workboard further includes a plurality of groups of spaced-apart upstanding rods arranged in respective predetermined patterns for frictional contact with the outer side surfaces of a plurality of the clothespin pairs and pin elements when arranged in juxtaposed, abutted and/or overlapping glued together relation to form toy chair subassemblies of the chair legs, sides, back and seat portions which are subsequently glued together to complete the chair.

3 Claims, 4 Drawing Figures

TOY CHAIR CONSTRUCTION KIT

BACKGROUND OF THE INVENTION

1. Field of the Invention

The present invention relates to toys and more particularly to a kit comprising a plurality of clothespins and a workboard for holding and glueing the clothespins in preselected positions relative to each other to form chair subassembly components.

2. Description of the Prior Art

The prior art discloses forming toy furniture including chairs, or the like, by assembling the units thereof which are formed or cut to a desired shape to be glued or pinned together to form the toy article. However, the prior patents do not disclose using known components, such as conventional clothespins which may be bonded together, as by gluing, to form toy furniture, such as chairs or rocking chairs.

This invention provides a kit or workpiece placement board for holding the wooden elements of spring clip-type clothespins in predetermined positions for gluing the clothespin elements together and assembling a toy chair or rocking chair.

SUMMARY OF THE INVENTION

The invention provides a kit comprising a workboard having a plurality of groups, of upstanding rods thereon disposed in a predetermined pattern to hold a plurality, twenty-two in the example shown, of conventional spring clip-type wooden clothespins enabling the purchaser to form a toy rocking chair. The spring clips are removed from the respective clothespin and discarded. The respective wooden elements of eleven of the clothespins are arranged by pairs in back to back contiguous contact and bonded together as by gluing. Eight of the eleven pairs of clothespin elements form the front legs, chair arms, the depending portion of the back legs and front portion of the chair rockers. The remaining three pairs of clothespin elements form a portion of the chair back. The remaining elements of the other clothespins form the remainder of the rockers, chair back, chair seat and chair leg braces.

The principal object is to provide a toy chair forming kit comprising a plurality of spring clip-type clothespins and a workboard guide containing a plurality of groups of upstanding clothespin element holding rods arranged in a predetermined pattern for holding the clothespin elements and forming chair subassemblies.

DESCRIPTION OF THE PREFERRED EMBODIMENT

Figure 1:
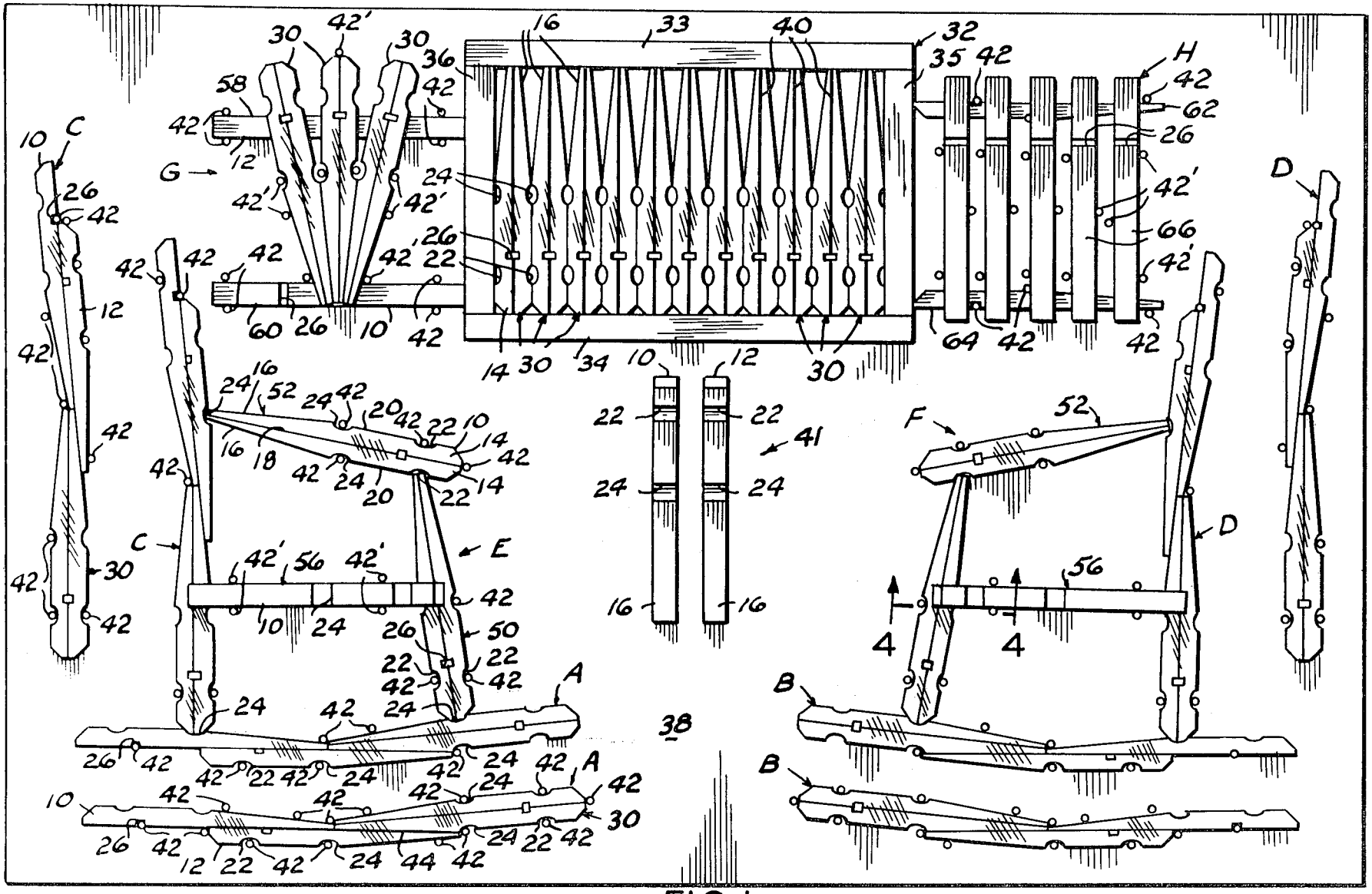
FIG. 1 is a top view of the workboard guide having a plurality of clothespin elements thereon forming chair subassemblies.

Like characters of reference designate like parts in those figures of the drawings in which they occur.

In the drawings:

In carrying out the invention and referring more particularly to FIG. 1, a plurality of conventional spring clip-type wooden clothespins are provided. The spring clips, not shown, are removed from the respective clothespin and discarded leaving the pair of wooden elements 10 and 12 of each clothespin, hereinafter referred to as "pin elements". The clothespin elements 10 and 12 are mirror images of each other, being rectangular in transverse section, having a head end portion 14, a lever end portion 16, and a planar back surface 18 parallel with a front surface 20. The front surface is characterized by a transverse recess 22 adjacent its head end 14 which normally grips a clothesline, not shown, and a similar transverse recess 24, intermediate its ends which previously nested the helical spring portion of the spring clip with the respective ends of the spring clip being nested by a transverse U-shaped groove 26 formed in the back surface 18 and disposed toward its head end portion 14. The front surface of the lever end portion of each pin element is further characterized by converging toward its back surface from the transverse recess 24.

A plurality of the pin elements 10 and 12 are disposed in back to back relation forming a plurality of clothespin element pairs 30, eleven pairs in the example shown, which are disposed in juxtaposed relation within a box area 32 formed by opposing upstanding side members 33 and 34 joined by end members 35 and 36, all overlying and secured to the top surface of a workboard 38.

Prior to placing the pairs of clothespin element pairs in back to back relation, the back surface of at least one of the elements 10 or 12 is coated with a suitable adhesive or bonding agent, such as glue, indicated by the heavy lines 40. The purpose of the box area 32 is to maintain the several pairs 30 in close fitting contact while the glue 40 hardens. As stated hereinabove, the purpose of the eleven pairs 30 is to form the chair front legs, arms, a portion of the back legs and rockers and a portion of the chair back in subassemblies, as presently explained. The remaining plurality of pin elements 10 and 12 of the twenty-two clothespins, indicated generally at 41, only two being shown, are used to form remaining portions of chair subassemblies, as presently explained.

Figure 4:
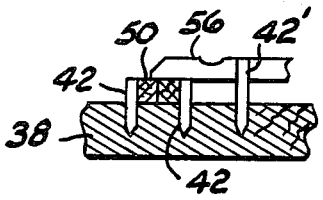
FIG. 4 is a fragmentary vertical cross sectional view taken substantially along the line 4—4 of FIG. 1.

Two of the pin element pairs 30 are used to form the forward end portion of rocker subassemblies A and B which are identical in structure and appearance with only the subassembly A described in detail. The pin element pair 30 is disposed flatly on the top surface of the workboard 38 with its head and lever end portions respectively abutting an upstanding metallic rod 42, each embedded at their other end portions in the workboard 38, (FIG. 4). A plurality of the rods 42 are used with the subassemblies A and B and other subassemblies, presently described, and since it is the placement of the rods with respect to the pairs 30 and associated pin elements 41, only the numeral 42 is used in the interest of clarity to indicate the respective rod, illustrated as small circles in FIG. 1. All of the rods 42 remain in their preselected position for the reasons presently explained. A pair of the rods 42 are nested by the pin element pair 30 recesses 22 and 24, respectively, thus holding the pair 30 against longitudinal or lateral movement. One of the clothespin elements 10 is then placed in lever end abutting relation against the pin element pair 30 with its back surface lying in the plane of one lever end surface of the pair 30 and its groove 26 nesting a rod 42. A pin element 12 is disposed so that its back surface longitudinally centrally overlaps the juncture of the lever end portions of the pin element 10 and pair 30 with its recesses 22 and 24 nesting rods 42 opposite the abutted lever end portions. The head end of the pin element 12 abuts a rod 42 with its lever end abutting a rod 42. Other rods 42 are spaced along the abutted lever end portions. Prior to placing the pin element 12 in contact with the pin element 10 and pair 30, the back surface of at least the pin element 12 is coated with glue, indicated by the heavy line 44.

Another two of the pin element pairs 30 are used to form the depending portion of the rocker back leg subassemblies C and D with only the subassembly C described in detail in the interest of brevity. The subassembly C is similar in appearance with the subassembly A characterized by disposing the head end of the pin element 12 adjacent the groove 26 of the pin element 10. A plurality of the rods 42 are similarly disposed on opposing surfaces of the subassembly C within selected recesses 22 and 24, the groove 26 of the pin element 10 and along the lever end portions as shown. After the glue has set, joining the components of the subassemblies A, B, C and D, these four subassemblies are manually lifted upwardly off the workboard 38 and four more of the pin element pairs 30 are used with these subassemblies to form the chair front legs and rocker arms and form chair side subassemblies E and F which are mirror images of each other and only the subassembly E is described in detail. The rocker subassembly A is disposed, as shown in the subassembly E, in contact with prelocated rods 42 holding the subassembly A in place. Similarly, the back leg subassembly C is disposed in upstanding relation, as viewed in FIG. 1, with its depending end in glued contact with the pin element 10 recess 24. Other rods 42, in contact with opposing surfaces of the subassembly C, hold it in place. One of the pin element pairs 30, forming the chair front leg 50, has its head end portion coated with glue and disposed in the rocker arm recess 24 with a plurality of rods 42, holding it in place. One of the pin element pairs 30, forming the rocker arm 52, has one of its recesses 22 nesting the lever end portion of the chair front leg 50 with its lever end portion nested by the adjacent chair back leg recess 24 with a coating of glue interposed between contacting surfaces. Rods 42, in contact with the arm 52, hold it in place. A chair side brace 56, comprising one of the pin elements 10, has its back surface flatly overlying, at its respective end portions, the chair front and back legs intermediate the height of the front leg 50. A plurality of rods 42' are disposed on opposing sides of the respective end portion of the chair brace 56. As shown by FIG. 4, these rods 42' are identical with the rods 42 except for their length or height above the top surface of the workboard 38 which is substantially equal to the combined thickness of any two of the pin elements 10 and 12.

The remaining three of the pin element pairs 30 are used to form the chair back subassembly G. A pair of clothespin elements 10 and 12, with the back surface facing upwardly, are disposed in parallel spaced relation with their respective lever ends abutting the box side member 36 to form chair back braces 58 and 60 and are maintained in this position by a plurality of the rods 42 disposed on opposing sides of the respective end portions of the back braces 58 and 60. The three pairs of pins 30 are disposed transversely of the back braces 58 and 60 in a fan array by juxtaposing their lever end portions which centrally overlie the back brace 60. A plurality of the rods 42', in contact with the fan array, maintain it in place while glue, interposed between overlapping surfaces, sets.

A chair seat assembly H is formed by a pair of pin elements 10 and 12 disposed in edgewise parallel spaced-apart relation with the head ends abutting the box end member 35 and define seat supports 62 and 64. At least three rods 42, contacting opposing surfaces of each of the supports 62 and 64, hold them in place. A plurality of the pin elements 10, five in the example shown, are then disposed in equally spaced parallel relation transversely of the seat supports 62 and 64 to form seat slats 66 with their respective wire notch recess 22 nesting an intermediate portion of the upper surface of the seat support 62 and their lever end portions overlapping the upper surface of the seat support 64. The surface of the seat slats 66, contacting the seat supports 62 and 64, are coated with glue prior to placement thereon and these slats are held in parallel spaced relation by a plurality of the rods 42' disposed in spaced relation on opposing sides of the respective slat.

Figure 2:
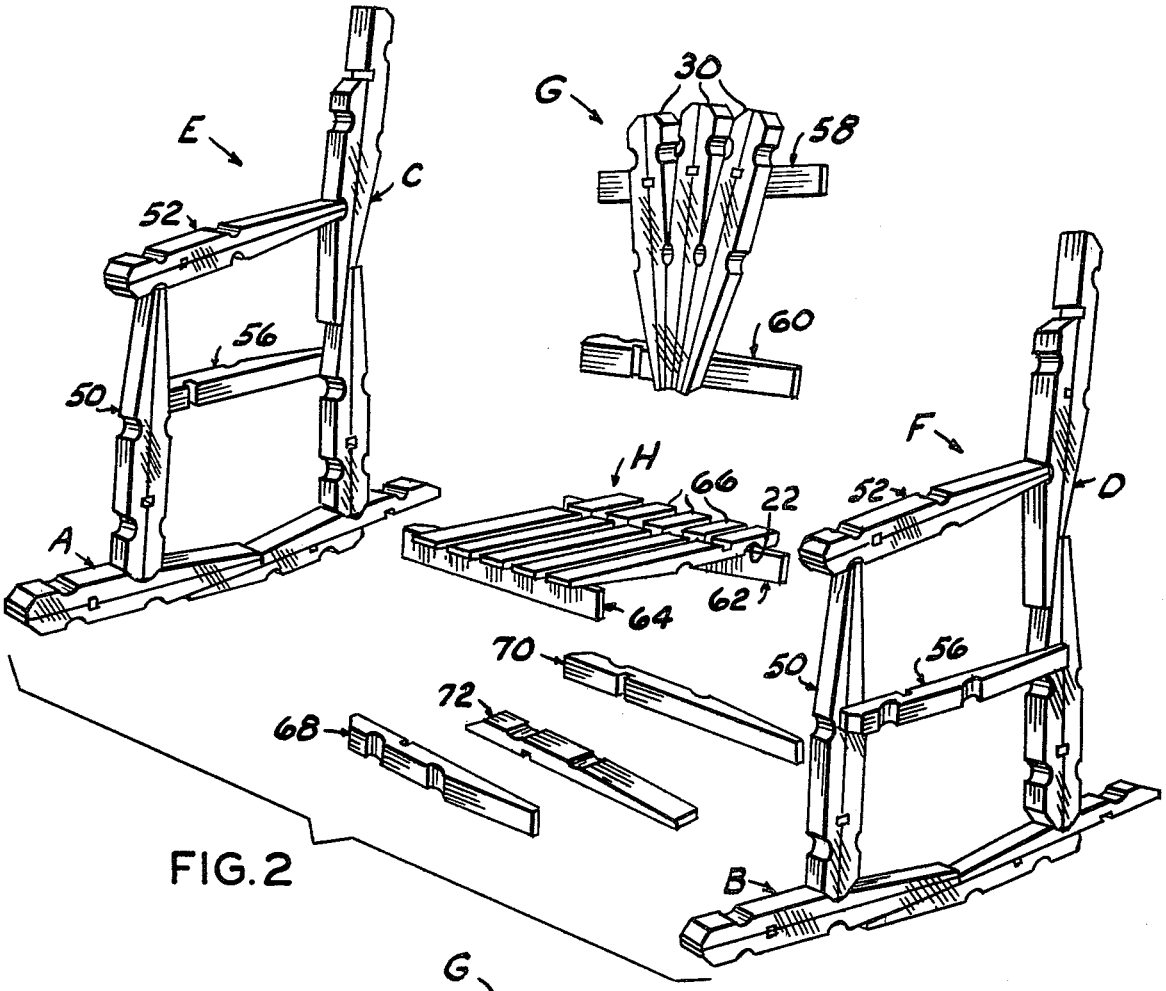
FIG. 2 is an exploded perspective view illustrating the toy chair forming subassemblies prior to being joined in chair forming position.
Figure 3:
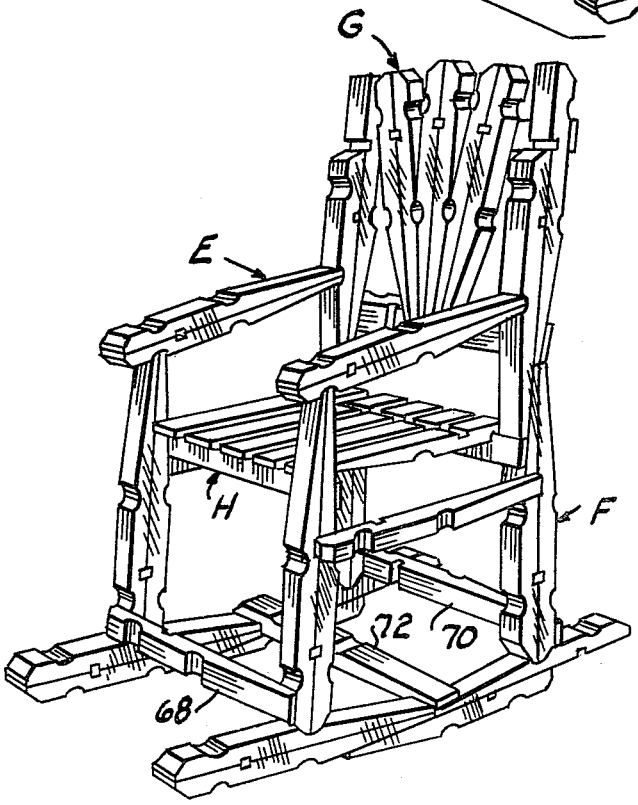
FIG. 3 is a perspective view of the completed toy chair.

After the glue has set in the respective subassemblies E, F, G and H, these subassemblies are bonded together to form the chair illustrated by FIG. 3, in the manner illustrated by FIG. 2. The chair side assemblies E and F are manually disposed in parallel side by side relation with the rocker subassemblies A and B resting on a common support surface. The seat assembly H is horizontally interposed between the chair side assemblies E and F with the seat support 62 end portions contacting the inner surface of the chair back leg above the side brace 56 and the other seat support 64 end portions contacting the inner surface of the front legs 50 with a coating of glue applied to the end portion of the seat supports contacting the chair legs. Similarly, the chair back assembly G has the respective end portions of its back braces 58 and 60 coated with glue and placed in contact with the back surface of the chair back legs with the lowermost back brace 60 overlying the upper end surface of the chair back base leg pairs 30 and with the chair back top brace 58 contacting the upper end portion of the chair back legs.

A plurality, preferably three, of the pin elements 41 form chair front and back legs and rocker braces, 68, 70 and 72, respectively. The front leg brace 68 extends between the depending end portion of the chair front legs 50 adjacent the upper surface of each rocker subassembly A and B. The cross brace 70 extends between the depending end of the chair back legs above the rocker subassemblies and the cross brace 72 extends between the rocker subassemblies intermediate the spacing between the front and back legs. Glue is similarly applied to the end portions of the chair leg braces before placing them in contact with the respective pair of legs and the rockers.

Obviously the invention is susceptible to changes or alterations without defeating its practicability. Therefore, I do not wish to be confined to the preferred embodiment shown in the drawings and described herein.

I claim:

1. In a toy chair forming kit in combination with a plurality of clothespins, each clothespin being characterized by a pair of separable elongated wooden pin elements rectangular in transverse section with each pin element further characterized by a head end, a lever end and coextensive front and back surfaces, the front and back surfaces each having at least one transverse indentation intermediate its ends, the improvement comprising: a planar rigid workboard having an upper surface;

means including side and end members on the workboard upper surface forming an upwardly open rectangular area for encompassing the perimeter of a plurality of juxtaposed pairs of the pin elements when arranged by pairs in back-to-back surface contiguous contact; and, at least one group comprising a plurality of upstanding rods, supported in spaced-apart relation by the workboard remote from the rectangular area and arranged in a predetermined pattern defining the perimeter of a plurality of juxtaposed or abutted pin elements when disposed on the workboard defining one chair side subassembly including front and back legs, a chair arm and chair legs cross brace of a toy chair.

2. The combination according to claim 1 and further including:

other groups of said upstanding rods arranged, respectively, in spaced-apart relation on the workboard upper surface in predetermined patterns defining the perimeter of a plurality of juxtaposed or abutted pin elements defining a chair rocker, a chair back and a chair seat subassembly of a toy chair.

3. The combination according to claim 2 in which at least one rod of the respective group of rods is nested by one said indentation for preventing longitudinal or lateral movement of the respective plurality of pin elements forming the respective toy chair subassembly relative to each other or to the workboard.

* * * * *